US010373750B2

(12) United States Patent
Ko et al.

(10) Patent No.: US 10,373,750 B2
(45) Date of Patent: Aug. 6, 2019

(54) APPARATUS AND METHOD OF GENERATING MOMENTUM USING SUPERCONDUCTING COILS

(71) Applicant: INDUSTRY-ACADEMIC COOPERATION FOUNDATION, YONSEI UNIVERSITY, Seoul (KR)

(72) Inventors: Tae Kuk Ko, Seoul (KR); Ji Ho Lee, Guri (KR); Woo Seung Lee, Bucheon (KR); Hyung Jun Kim, Jeonju (KR); Seok Ho Nam, Chungcheongbuk-do (KR); Young Gun Park, Seoul (KR); Jin Sub Kim, Seoul (KR)

(73) Assignee: INDUSTRY-ACADEMIC COOPERATION FOUNDATION, YONSEI UNIVERSITY, Seoul (KR)

( * ) Notice: Subject to any disclaimer, the term of this patent is extended or adjusted under 35 U.S.C. 154(b) by 1078 days.

(21) Appl. No.: 14/749,038

(22) Filed: Jun. 24, 2015

(65) Prior Publication Data

US 2016/0123703 A1 May 5, 2016

(30) Foreign Application Priority Data

Oct. 31, 2014 (KR) ..... 10-2014-0149875

(51) Int. Cl.
*H01F 6/06* (2006.01)
*H01F 6/00* (2006.01)

(52) U.S. Cl.
CPC ..... *H01F 6/06* (2013.01); *H01F 6/008* (2013.01)

(58) Field of Classification Search
CPC ..... H01F 6/06; H01F 6/008
See application file for complete search history.

(56) References Cited

U.S. PATENT DOCUMENTS

| | | | | |
|---|---|---|---|---|
| 5,182,254 | A | 1/1993 | Owens | |
| 2009/0190274 | A1* | 7/2009 | Ko | H02H 9/023 361/19 |
| 2015/0206635 | A1* | 7/2015 | Murase | H01F 6/02 505/166 |

FOREIGN PATENT DOCUMENTS

| | | | | |
|---|---|---|---|---|
| JP | 2010-252413 | A | 11/2010 | |
| KR | 10-2007-00986009 | A | 8/2007 | |
| KR | 10-0827738 | B1 | 5/2008 | |
| WO | WO 2014/020805 | * | 2/2014 | H01F 6/02 |

* cited by examiner

*Primary Examiner* — Paul A Wartalowicz

(57) ABSTRACT

The present invention relates to an apparatus of generating momentum which drives an object. The present invention provides a momentum generating apparatus in which a pair of high temperature superconducting coils which are wound in different directions and have different superconducting properties are arranged in parallel and the same current flows in the pair of coils to be in a stable state where magnetic fields generated in the coils are cancelled and an asymmetric current is suddenly applied to the pair of coils through a switching operation to generate a magnetic field and an eddy current is induced in a plate due to the generated magnetic field and the plate is floated using a repulsive force between the magnetic field generated in the plate due to the eddy current and the magnetic field generated in the pair of coils, to instantaneously generate force using a small amount of superconducting coils.

12 Claims, 7 Drawing Sheets

[Fig.1]
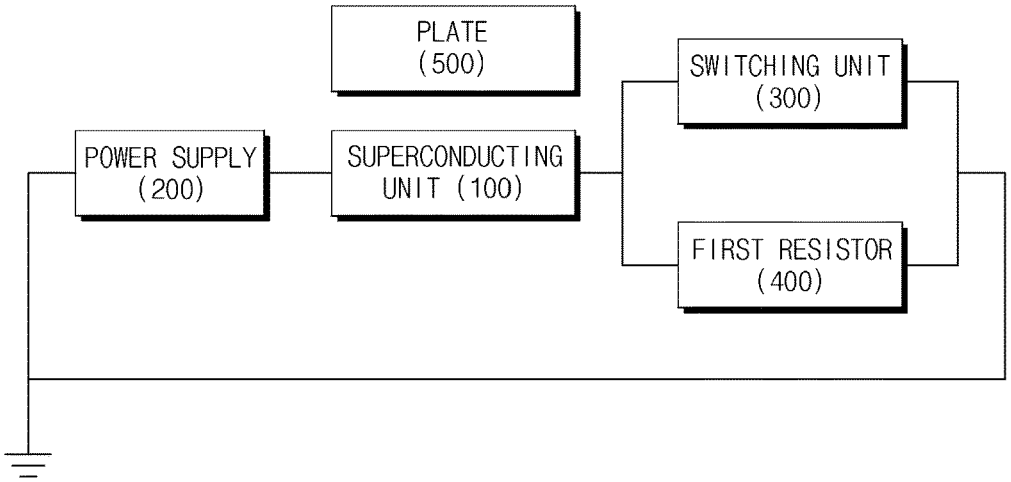
[Fig.2]
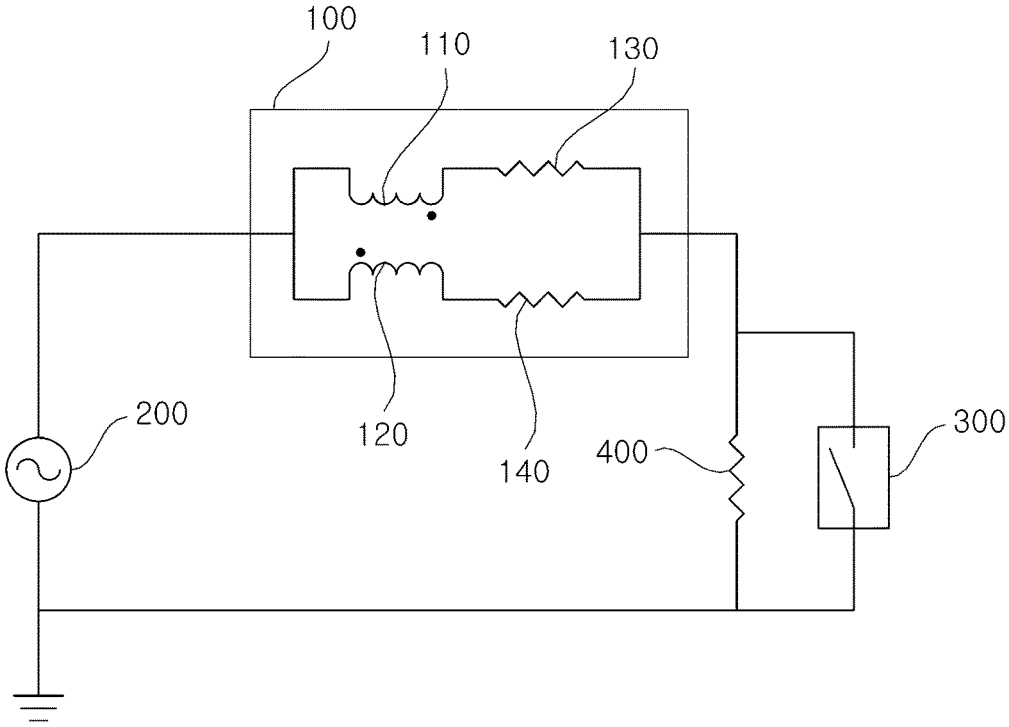

[Fig.3]
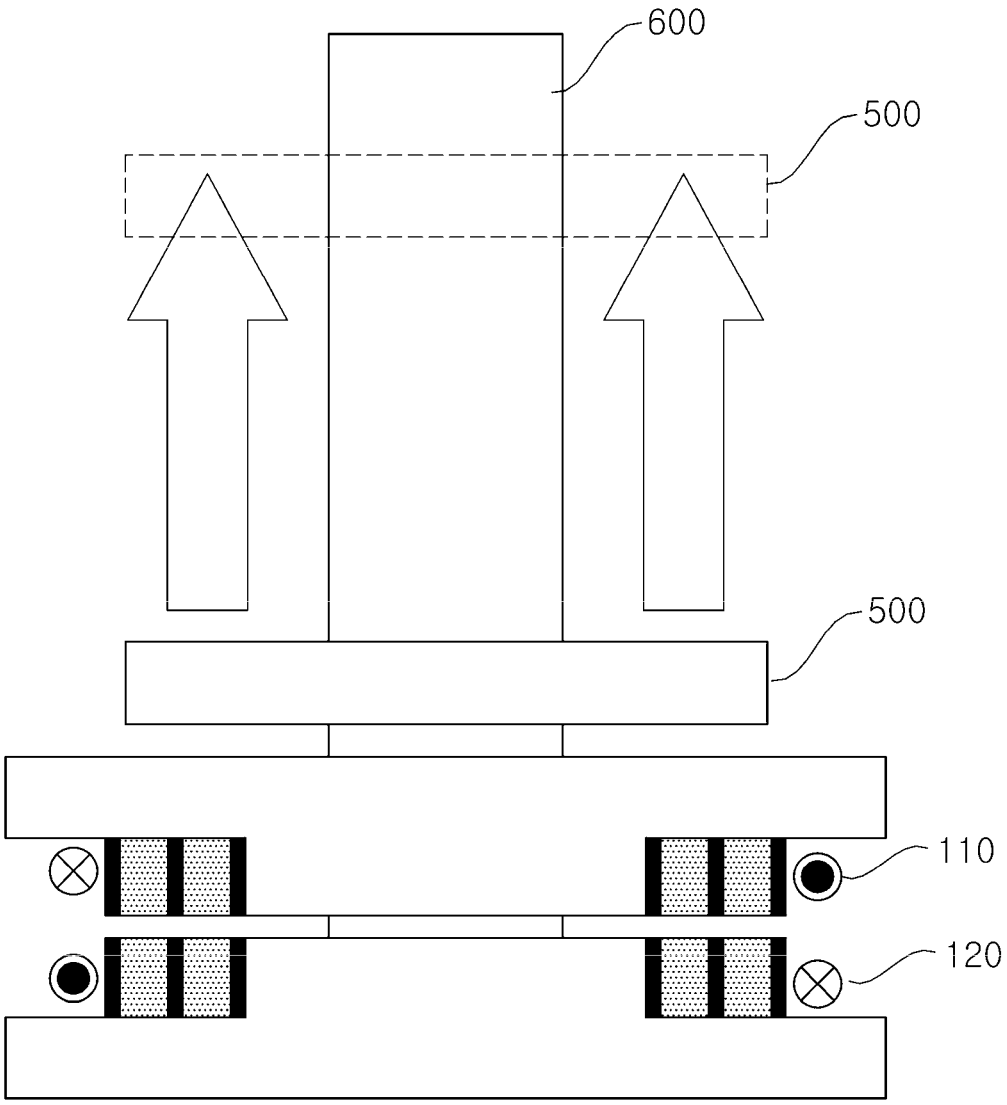

[Fig.4]
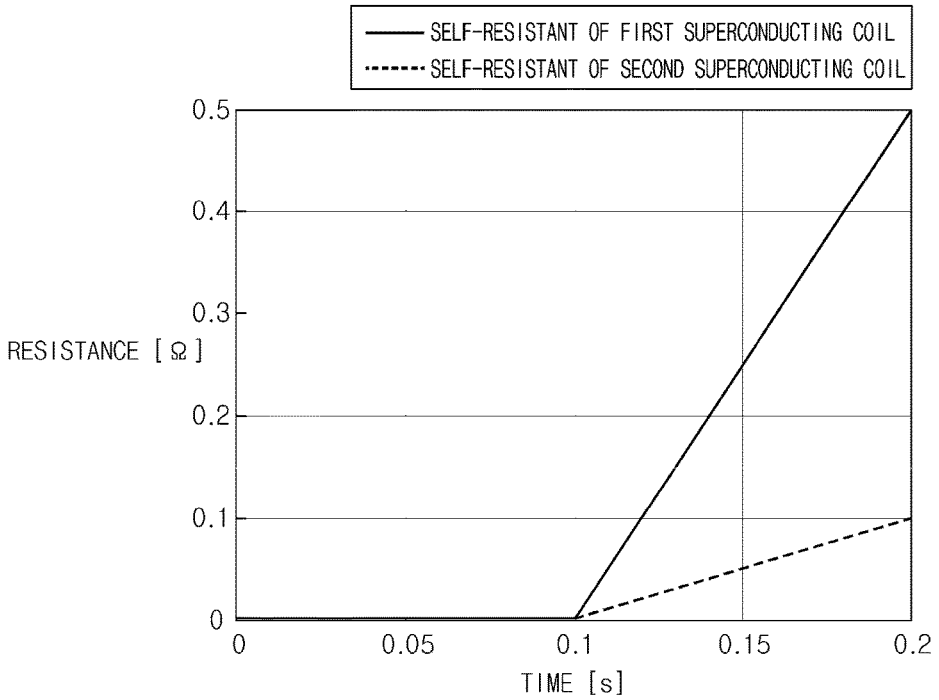

[Fig.5]
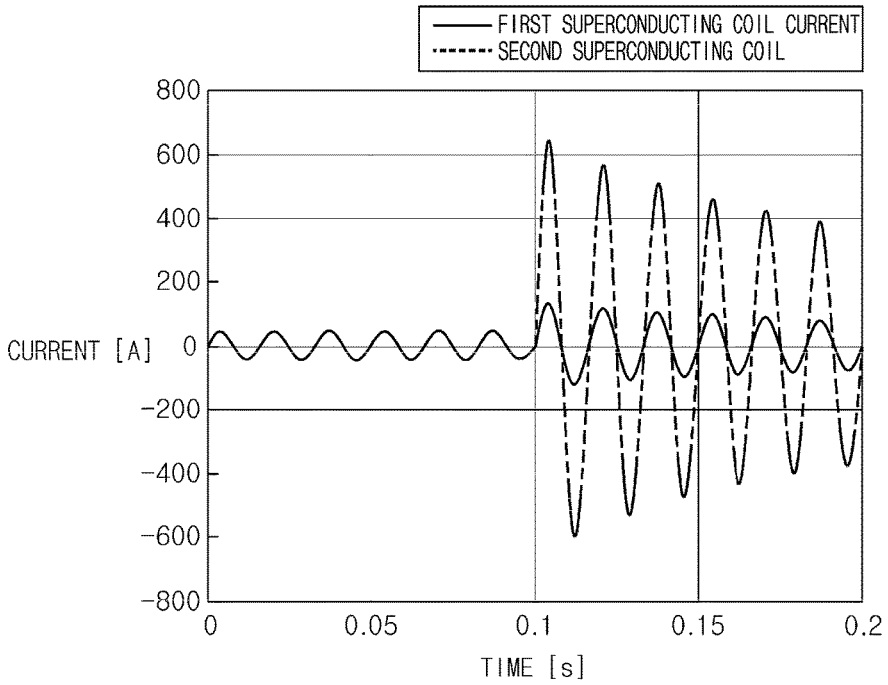

[Fig.6]
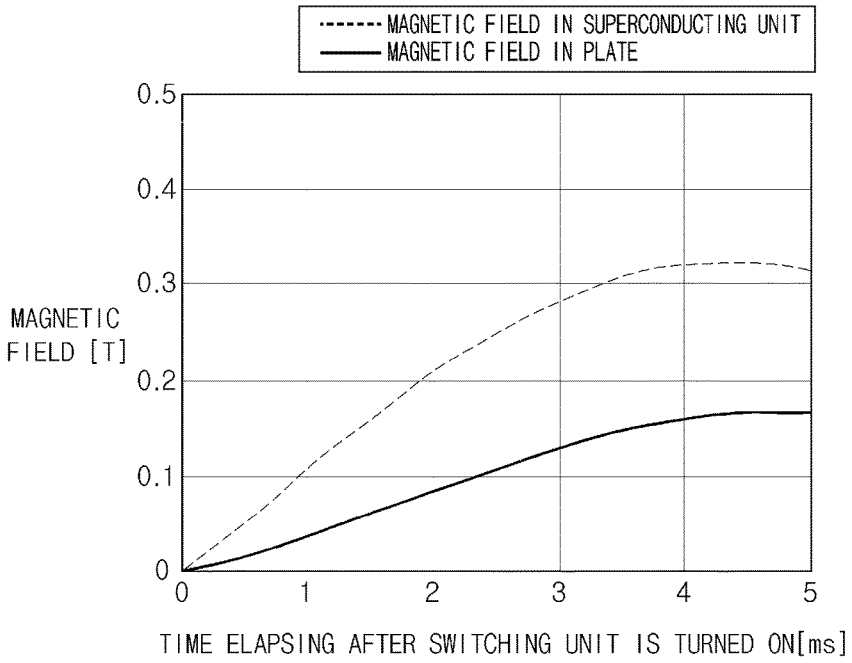

[Fig.7]
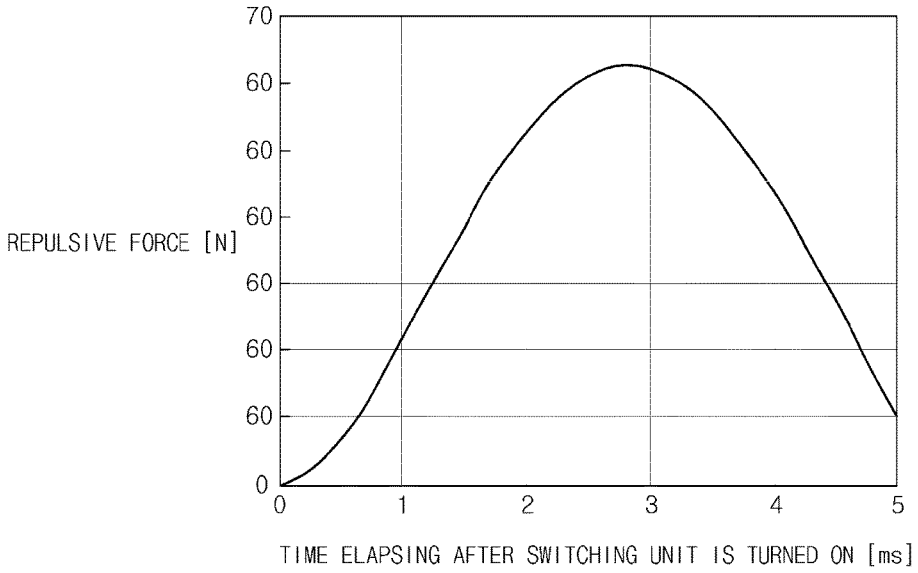

[Fig.8]
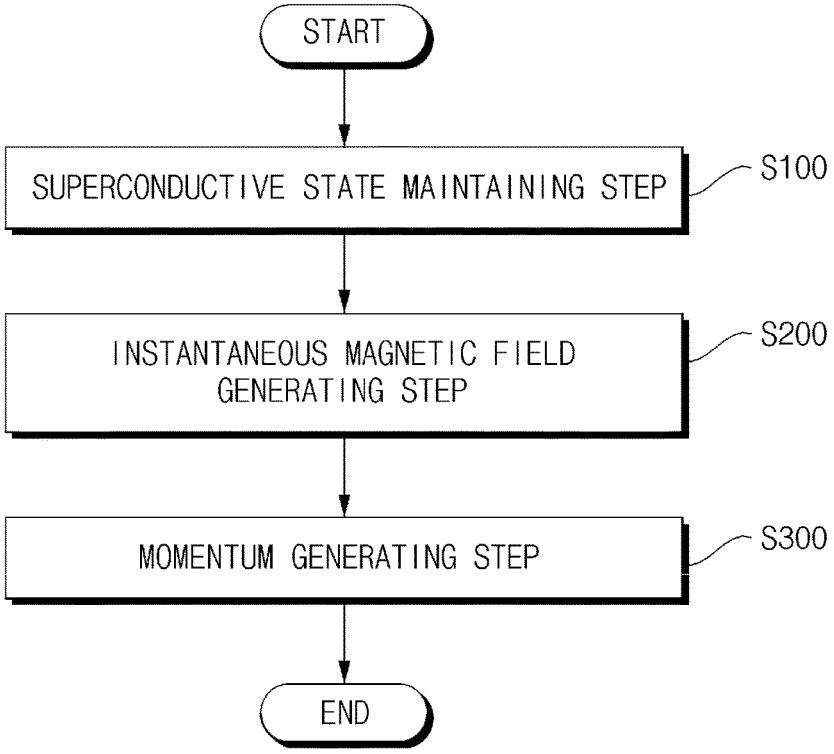

APPARATUS AND METHOD OF GENERATING MOMENTUM USING SUPERCONDUCTING COILS

CROSS-REFERENCE TO RELATED APPLICATIONS

This application claims priority to and the benefit of Korean Patent Application No. 10-2014-0149875 filed in the Korean Intellectual Property Office on Oct. 31, 2014, the entire contents of which are incorporated herein by reference.

TECHNICAL FIELD

The present invention relates to an apparatus of generating momentum which drives an object.

BACKGROUND ART

An apparatus which generates force to drive an object in a specific direction may be utilized in various fields. Specifically, in order to levitate an object such as a rocket, very large momentum is required at an initial stage and thus high cost is consumed in order to generate the large momentum.

As an apparatus of generating the momentum according to the related art, there is an apparatus of obtaining momentum by burning chemical fuel. However, such an apparatus has a limitation in that a large amount of chemical fuels is consumed and a specific environment for combustion needs to be built. Further, a general method which generates momentum using an elastic body may also be considered, but the method has a disadvantage in that the elastic body has a limited life span and the elastic body needs to be reset for every use.

As disclosed in the following Patent Documents, in the related art, there are devices which levitate an object using a permanent magnet or a superconductor. However since the devices are developed to continuously levitate the object, the devices have limitation in that the devices are not used to apply the momentum to move the object.

RELATED ART DOCUMENT (Patent Document 1) Korean Unexamined Patent Application Publication No. 10-2007-0086009

(Patent Document 2) Japanese Patent Publication No. 22252413 (published on Nov. 4, 2010)

SUMMARY OF THE INVENTION

The present invention has been made in an effort to provide a momentum generating apparatus in which a pair of high temperature superconducting coils which are wound in different directions and have different superconducting properties are arranged in parallel and the same current flows in the pair of coils so as to be in a stable state when magnetic fields generated in the coils are cancelled and an asymmetric current is suddenly applied to the pair of coils through a switching operation to generate a magnetic field and an eddy current is induced in a plate due to the generated magnetic field while the plate is floated using repulsive force between the magnetic field generated in the plate due to the eddy current and the magnetic field generated in the pair of coils, to instantaneously generate large force using a small amount of high temperature superconducting coils.

An exemplary embodiment of the present invention provides a momentum generating apparatus using a superconducting coil, including: a superconducting unit which includes a pair of a first superconducting coil unit and a second superconducting coil unit which are wound in different directions, have different superconductive properties, and are arranged in parallel; a power supply which supplies an AC power to the superconducting unit; and a switching unit which is connected to the superconducting unit and closes or opens a circuit in accordance with the manipulation.

When the switching unit is turned on to connect circuits at both sides of the switching unit, the superconducting unit may instantaneously generate a predetermined amount or more of a magnetic field within a predetermined time.

The first superconducting coil unit and the second superconducting coil unit may be high temperature superconductors having a critical temperature for having a superconductive property which is set to a predetermined temperature or higher.

The first superconducting coil unit and the second superconducting coil unit may be wound in opposite directions so that the superconducting unit has a non-inductive property.

The first superconducting coil unit and the second superconducting coil unit may be superconductors having different critical currents and different N coefficients (n values) and may be connected in parallel.

The momentum generating apparatus using a superconducting coil according to an exemplary embodiment of the present invention may further include: a first resistor which is connected to the superconducting unit in series, in which the switching unit may be connected to the first resistor in parallel, and when the switching unit is turned on, circuits at both sides of the switching unit may be connected and when the switching unit is turned off, the current which flows in the first resistor may flow in the circuits connected through the switching unit.

The superconducting unit may include a first adjustment resistor which is connected to the first superconducting coil unit in series and a second adjustment resistor which is connected to the second superconducting coil unit in series to adjust current amounts which flow in the first superconducting coil unit and the second superconducting coil unit.

The first adjustment resistor and the second adjustment resistor may have resistances which are lower than the resistance of the first resistor at a predetermined rate or lower.

When the switching unit is turned off, the circuits at both sides of the switching unit may be disconnected and a current may flow in the first resistor in accordance with a voltage which is applied by the power supply, and a predetermined reference or lower of current may flow in the first superconducting coil unit and the second superconducting coil unit, so that the first superconducting coil unit and the second superconducting coil unit are maintained to be a superconductive state.

The circuits at both sides of the switching unit may be disconnected and a current may flow in the first resistor in accordance with a voltage which is applied by the power supply, and when the switching unit is turned off, the current amount which flows in the first superconducting coil unit and the current amount which flows in the second superconducting coil unit may be equal to each other or a difference between the current amounts may be a predetermined reference or less, and a magnetic field generated by the first superconducting coil unit and a magnetic field generated by the second superconducting coil unit may be cancelled by each other.

When the switching unit is turned on, circuits at both sides of the switching unit may be connected to flow the current in a circuit which is connected through the switching unit, instead of the first resistor, in accordance with the voltage which is applied by the power supply, a predetermined reference or higher of current may flow in the first superconducting coil unit and the second superconducting coil unit to break the superconductive states of the first superconducting coil unit and the second superconducting coil unit, and a resistance of a self-resistor of the first superconducting coil unit and a resistance of a self-resistor of the second superconducting coil unit may be increased at different speeds during a predetermined time after the switching unit is turned on.

When the switching unit is turned on, during a predetermined time after the switching unit is turned on, a difference between a current amount which flows in the first superconducting coil unit and a current amount which flows in the second superconducting coil unit may be equal to or larger than a predetermined reference, so that a current asymmetrically flows in the first superconducting coil unit and the second superconducting coil unit, and a magnetic field generated by the first superconducting coil unit and a magnetic field generated by the second superconducting coil unit may not be cancelled, so that the superconducting unit instantaneously generates a predetermined amount or more of magnetic field within a predetermined time.

The apparatus may further include a plate which is configured by a conductor, and the plate may be disposed to be parallel to the first superconducting coil unit and the second superconducting coil unit of the superconducting unit.

An eddy current may be generated in the plate due to the magnetic field which is instantaneously generated in the superconducting unit within a predetermined time, a predetermined amount or more of magnetic field may be instantaneously generated in the plate within a predetermined time, due to the generated eddy current, and a magnetic field generated in the plate due to the eddy current and a magnetic field generated in the superconducting unit may have opposite directions and generate repulsive force between the plate and the superconducting unit.

The apparatus may further include a supporting unit which fixes the positions of the first superconducting coil unit and the second superconducting coil unit to be parallel to the plate and guides the movement of the plate when the plate moves in one direction due to a repulsive force between the superconducting unit and the plate.

Another exemplary embodiment of the present invention provides a momentum generating method using a superconducting coil, including: a superconductive state maintaining step which connects a first resistor and an AC power supply to a superconducting unit, which is formed of a pair of a first superconducting coil unit and a second superconducting coil unit which are wound in different directions, have different superconductive properties, and are arranged in parallel to each other and connected in parallel, in series and flows a current to maintain the superconductive state of the pair of the superconducting coil units and disposes a plate to be parallel to the superconducting unit; an instantaneous magnetic field generating step which shorts both sides of the first resistor, so that more currents asymmetrically flow in the pair of the first superconducting coil unit and the second superconducting coil unit, as compared with the current which has flowed in the pair of the first superconducting coil unit and the second superconducting coil unit, and instantaneously generates a predetermined amount or more of magnetic field in the superconducting unit within a predetermined time; and a momentum generating step which generates a repulsive force in the plate in accordance with the magnetic field generated in the superconducting unit to float the plate.

The first superconducting coil unit and the second superconducting coil unit may be high temperature superconductors which are objects whose critical temperature for having a superconductive property is set to a predetermined temperature or higher and be wounded in opposite directions so that the superconducting unit has a non-inductive property, and have different critical currents and different N coefficients (n values).

In the instantaneous magnetic generating step, both sides of the first resistor may be shorted using a switch or a circuit which is connected to the first resistor in parallel to instantaneously flow a predetermined reference or higher of current in the first superconducting coil unit and the second superconducting coil unit within a predetermined time, and the superconducting unit instantaneously may generate a predetermined amount or more of magnetic field within a predetermined time using the first superconducting coil unit and the second superconducting coil unit in which currents asymmetrically flow due to different superconductive properties and different strengths of magnetic fields are generated.

In the momentum generating step, an eddy current may be generated in the plate due to the magnetic field which is generated in the instantaneous magnetic field generating step and a predetermined amount of magnetic field may be instantaneously generated in the plate due to the generated eddy current within a predetermined time, and a magnetic field generated in the plate due to the eddy current and a magnetic field generated in the superconducting unit may have opposite directions and generate repulsive force between the plate and the superconducting unit to move the plate in accordance with the repulsive force.

According to the momentum generating apparatus using superconducting coils of the present invention, large force is instantaneously generated using a small amount of superconducting coils to levitate an object.

The apparatus generates momentum to be provided for a device which drives the object in a predetermined direction.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE DRAWINGS

FIG. 1 is a block diagram of a momentum generating apparatus using a superconducting coil according to an exemplary embodiment of the present invention.

FIG. 2 is a circuit diagram of a momentum generating apparatus using a superconducting coil according to an exemplary embodiment of the present invention.

FIG. 3 is a referential view illustrating an exemplary embodiment of a momentum generating apparatus using a superconducting coil according to an exemplary embodiment of the present invention.

FIG. 4 is a referential view illustrating a characteristic of self-resistances of a first superconducting coil unit and a second superconducting coil unit which change in accordance with time when a switching unit according to an exemplary embodiment of the present invention is turned on.

FIG. 5 is a referential view illustrating a characteristic of current amounts, which flow in a first superconducting coil unit and a second superconducting coil unit, which change in accordance with time when a switching unit according to an exemplary embodiment of the present invention is turned on.

FIG. 6 is a referential view explaining a change of a magnetic field generated in a superconducting unit and a magnetic field generated in a plate in accordance with the time when a switching unit according to an exemplary embodiment of the present invention is turned on.

FIG. 7 is a referential view explaining a change of a repulsive force which is generated between the superconducting unit and the plate due to interaction between a magnetic field generated in the superconducting unit and a magnetic field generated in the plate, in accordance with the time, when a switching unit according to an exemplary embodiment of the present invention is turned on.

FIG. 8 is a flowchart of a momentum generating method using a superconducting coil according to another exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Hereinafter, exemplary embodiments of the present invention will be described in detail with reference to the accompanying drawings. In the figures, even though the parts are illustrated in different drawings, it should be understood that like reference numbers refer to the same or equivalent parts of the present invention. Furthermore, when it is judged that a specific description of known configurations or functions related in the description of the present invention may unnecessarily obscure the essentials of the present invention, the detailed description will be omitted. Further, hereinafter, exemplary embodiments of the present invention will be described. However, it should be understood that the technical spirit of the invention is not limited to the specific embodiments, but may be changed or modified in various ways by those skilled in the art.

FIG. 1 is a block diagram of a momentum generating apparatus using a superconducting coil according to an exemplary embodiment of the present invention and FIG. 2 is a circuit diagram of a momentum generating apparatus using a superconducting coil according to an exemplary embodiment of the present invention.

A momentum generating apparatus using a superconducting coil according to the exemplary embodiment of the present invention may include a superconducting unit 100, a power supply 200, a switching unit 300, a first resistor 400, a plate 500, and a supporting unit 600. Here, the first resistor 400, the plate 500, and the supporting unit 600 may be selectively added or omitted, if necessary. For example, the momentum generating apparatus using a superconducting coil according to the exemplary embodiment of the present invention may include the superconducting unit 100, the power supply 200, the switching unit 300, the first resistor 400, the plate 500, and the supporting unit 600 or include the superconducting unit 100, the power supply 200, the switching unit 300, the first resistor 400, and the plate 500, or include the superconducting unit 100, the power supply 200, the switching unit 300, and the first resistor 400. Hereinafter, an optimal embodiment including all the superconducting unit 100, the power supply 200, the switching unit 300, the first resistor 400, the plate 500, and the supporting unit 600 will be described in detail.

The superconducting unit 100 includes a pair of a first superconducting coil unit 110 and a second superconducting coil unit 120 which are wound in different directions, have different superconducting properties, and are arranged in parallel to each other.

Here, the first superconducting coil unit 110 and the second superconducting coil unit 120 are wound by winding wires having different superconducting properties in different directions.

Here, the first superconducting coil unit 110 and the second superconducting coil unit 120 are disposed to be parallel to each other so that directions of axes at which the coils are wound are parallel to each other. For example, the first superconducting coil unit 110 and the second superconducting coil unit 120 are disposed to be parallel to each other as illustrated in FIG. 3.

As described above, the first superconducting coil unit 110 and the second superconducting coil unit 120 are wound in opposite directions so that the superconducting unit 100 has a non-inductive property. Here, the non-inductive property is a phenomenon generated when magnetic fields generated in opposite directions in the first superconducting coil unit 110 and the second superconducting coil unit 120 are cancelled.

The first superconducting coil unit 110 and the second superconducting coil unit 120 are high temperature superconductors having a critical temperature for having a superconductive property which is set to a predetermined temperature or higher. For example, the high temperature superconductor may have superconductive property at a temperature equal to or lower than a critical temperature which is set to 30 K or higher. For example, an object such as YBCO, GdBCO, or BSCCO has a superconductive property at a critical temperature of 90 to 110 K.

If necessary, the first superconducting coil unit 110 and the second superconducting coil unit 120 may be configured by low temperature superconductors which are objects having a critical temperature for having a superconductive property which is set to a predetermined temperature or lower.

The first superconducting coil unit 110 and the second superconducting coil unit 120 may be superconductors which have different critical currents and different N coefficients (n values). That is, the superconductive properties may be the critical current and the N coefficient. Here, the critical current means a strength of the current which may flow in the superconductor having a superconductive property. Further, the N coefficient means a coefficient which defines an electric property of the superconductor together with the critical current and may be a coefficient in E-J power law of the following Equation 1 which is a law representing a relationship between a voltage which is applied to the superconductor and a current which flows in the superconductor.

$$\frac{V}{V_c} = \left(\frac{I}{I_c}\right)^n \quad \text{Equation 1}$$

(Here, Ic is a critical current, Vc is a voltage which is applied to the superconductor when the critical current flows in the superconductor, V is a voltage which is applied to the superconductor, I is a current which flows in the superconductor, and n is the N coefficient).

As understood from Equation 1, the voltage in accordance with the current which flows in the superconductor has a relationship of an exponential function. When a current which is equal to or higher than the critical current flows in the superconductor, if the N coefficient is large, the voltage which is applied to the superconductor is rapidly increased and if the N coefficient is small, the voltage is more gradually increased.

Here, a basic principle of the present invention that a magnetic field is instantaneously generated using a superconducting coil pair which is wound in different directions and has different superconductive properties will be described in brief.

When the current is applied, magnetic fields having different directions are generated in the superconducting coil units which are wound in different directions and as a result, the generated magnetic fields are cancelled by a difference of the strengths of the magnetic fields. First, the momentum generating apparatus using the superconducting coil according to an exemplary embodiment of the present invention flows a small current having a strength which is equal to or smaller than a predetermined strength in the superconducting coil unit pair to maintain a superconductive state and flows currents which has the same strength or has a strength equal to or lower than a predetermined strength to cancel the magnetic fields generated in the superconducting coil unit pair in a superconductive state. Here, a reference current amount having a predetermined strength which flows in the superconducting coil unit pair to maintain the superconductive state may be determined depending on superconductive properties of the superconducting coil units.

Next, a momentum generating apparatus using a superconducting coil according to an exemplary embodiment of the present invention flows current having a large strength which is equal to or larger than a predetermined strength of the superconducting coils in the superconducting coil unit pair to break the superconductive state of the superconducting coil units. Here, a reference current amount having a predetermined strength which flows in the superconducting coil unit pair to break the superconductive state may be determined depending on a property of a critical current among the superconductive properties of the superconducting coil units. That is, a large current which is equal to or higher than the critical current of the superconducting coil flows in the superconducting coil unit pair to break the superconductive state of the superconducting coil units. In this case, due to different superconductive properties of the first superconducting coil unit 110 and the second superconducting coil unit 120, a resistance of the first superconducting coil unit 110 and a resistance of the second superconducting coil unit 120 are different from each other and as a result, amounts of current which flow in the superconducting coil units are also different from each other. Further, for this reason, strengths of the magnetic fields which are generated by the superconducting coil units are different from each other. Therefore, the magnetic fields generated in the first superconducting coil unit 110 and the second superconducting coil unit 120 are not completely cancelled, so that a predetermined strength or higher of magnetic field is instantly generated in the superconducting unit 100 in one direction.

In the exemplary embodiment of the present invention, the plate 500 is disposed to be parallel to the pair of the superconducting coils. In this case, eddy current is induced in the plate 500 due to the instant magnetic field generated in the superconducting unit 100 and as a result, a magnetic field is also generated in the plate 500 in accordance with the eddy current. In this case, the magnetic field generated in the superconducting unit 100 and the magnetic field generated in the plate 500 are formed in different directions, so that the magnetic fields are resistant to each other.

Therefore, due to the magnetic field generated in the superconducting unit 100 and the magnetic field generated in the plate 500 which are resistant to each other, repulsive force is generated between the superconducting unit 100 and the plate 500 and thus the plate 500 is repelled in one direction.

An operation of each configuration of the exemplary embodiment of the present invention in accordance with a basic principle of the present invention as described above will be described in more detail below.

Next, a configuration and an operation of the superconducting unit 100 will be described again.

The first superconducting coil unit 110 and the second superconducting coil unit 120 of the superconducting unit 100 may be connected in parallel in a circuit. Since the first superconducting coil unit 110 and the second superconducting coil unit 120 are connected in parallel, the same voltage is applied. As a result, when a superconductive state of the superconducting coil units is broken, magnetic fields having different strengths are generated in each coil in accordance with the different superconductive properties of both coils and different self-resistances of the superconducting coils.

In order to adjust the amounts of current which flow in the first superconducting coil unit 110 and the second superconducting coil unit 120, the superconducting unit 100 may include a first adjustment resistor 130 which is connected to the first superconducting coil unit 110 in series and a second adjustment resistor 140 which is connected to the second superconducting coil unit 120 in series.

The first adjustment resistor 130 and the second adjustment resistor 140 may have a smaller resistance at a predetermined rate or lower as compared with the first resistor 400 which will be described below. Here, the predetermined rate may be a small rate such as 1:1000 to 1:10000 at which a sufficiently large current flows in the superconducting unit 100 to break a non-inductive property.

The power supply 200 supplies an AC power to the superconducting unit 100.

In this case, any one of either sides of the power supply or both sides of the first resistor 400 may be grounded.

The switching unit 300 is connected to the superconducting unit 100 to close or open the circuit in accordance with manipulation.

Here, the switching unit 300 makes the circuit a short circuit in accordance with the manipulation to instantaneously increase the amount of current which flows in the superconducting unit 100.

Here, when the switching unit 300 is turned on to connect both circuits of the switching unit 300, the superconducting unit 100 instantaneously generates a predetermined amount or more of the magnetic field within a predetermined time.

For example, the superconducting unit 100 may generate a predetermined amount or more of the magnetic field which is determined by an amount of applied voltage of the power supply 200 and a superconductive property of the first superconducting coil unit 110 and the second superconducting coil unit 120 within several or several tens of milliseconds.

The first resistor 400 may be connected to the superconducting unit 100 in series.

Here, the switching unit 300 may be connected to the first resistor 400 in parallel.

Here, when the switching unit 300 is turned on, both circuits of the switching unit 300 are connected, so that the current which flows in the first resistor 400 when the switching unit 300 is turned off flows in the circuits connected through the switching unit 300. That is, when the switching unit 300 is turned on, both sides of the first resistor 400 are connected, so that the current which has flowed through the first resistor 400 flows to the circuits connected through the switching unit 300 without having a resistor.

The configuration of the switching unit 300 and the first resistor 400 as described above causes the large amount of current to instantaneously flow in the superconducting unit 100. That is, when a resistance of the first adjustment resistor 130 and a resistance of the second adjustment resistor 140 are smaller than a resistance of the first resistor 400 at a predetermined rate or smaller, most of the voltage which is applied by the power supply 200 in a state where the switching unit 300 is turned off is applied to the first resistor 400 rather than to the superconducting unit 100. Further, in order to adjust the amount of current which flows in the superconducting unit 100 so as to maintain the superconductive state of the first superconducting coil unit 110 and the second superconducting coil unit 120, the first resistor 400 may be set to have a predetermined resistance or larger. However, as described above, when the switching unit 300 which has been turned off is turned on, all the voltage which has been applied to the first resistor 400 is applied to the superconducting unit 100 and thus, a large current instantaneously flows in the superconducting unit 100.

The plate 500 may be disposed to be parallel to the first superconducting coil unit 110 and the second superconducting coil unit 120 of the superconducting unit 100.

Here, as illustrated in FIG. 3, the plate 500 may be disposed to be parallel to the first superconducting coil unit 110 and the second superconducting coil unit 120. That is, a direction of an axis of the first superconducting coil unit 110 and the second superconducting coil unit 120 at which the coil is wound and a direction of a central axis which is perpendicular to the plate at a center of the plate 500 may be parallel to each other.

The momentum generating apparatus using a superconducting coil according to the exemplary embodiment of the present invention may further include the supporting unit 600.

Here, the supporting unit 600 may fix the positions such that the first superconducting coil unit 110 and the second superconducting coil unit 120 are parallel to the plate 500 and as it will be described below, may guide the movement of the plate unit 500 when the plate 500 moves in one direction due to the repulsive force between the plate 500 and the superconducting unit 100.

FIG. 3 is a referential view illustrating an exemplary embodiment of a momentum generating apparatus using a superconducting coil according to an exemplary embodiment of the present invention.

Referring to FIG. 3, the momentum generating apparatus using a superconducting coil according to the exemplary embodiment of the present invention may include the first superconducting coil unit 110 and the second superconducting coil unit 120 at a lower portion to be parallel to each other. Here, the first superconducting coil unit 110 and the second superconducting coil unit 120 are wound in different directions as illustrated in FIG. 2. The plate 500 may be disposed to be parallel to an upper portion of the first superconducting coil unit 110 and may be instantaneously levitated due to the repulsive force generated between the plate 500 and the superconducting unit 100. In this case, the supporting unit 600 may support each part so as to maintain parallelism between the first superconducting coil unit 110 and the second superconducting coil unit 120 and the plate 500.

The momentum generating apparatus using a superconducting coil according to the exemplary embodiment of the present invention selectively form a short circuit using the switching unit 300 and the first resistor 400 to adjust the voltage and the current which is supplied to the superconducting unit 100 as described above, thereby causing a predetermined amount or more of magnetic field to be instantaneously generated in the superconducting unit 100 within a predetermined time.

Next, in cases when the switching unit 300 is turned on and turned off, that is, a case when the switching unit is turned on to connect circuits at both sides of the switching unit through the switching unit and a case when the switching unit is turned off to disconnect the circuits at both sides of the switching unit which are connected by the switching unit, an operation of the momentum generating apparatus using a superconducting coil according to an exemplary embodiment of the present invention will be described in detail with reference to the drawing.

First, the case when the switching unit 300 is turned off will be described.

When the switching unit 300 is turned off, circuits at both sides of the switching unit 300 are disconnected and a current flows in the first resistor 400 in accordance with the voltage which is applied by the power supply 200.

In this case, a current which is equal to or lower than a predetermined reference flows in the first superconducting coil unit 110 and the second superconducting coil unit 120, so that the superconductive states of the first superconducting coil unit 110 and the second superconducting coil unit 120 may be maintained. Here, the current which is equal to or lower than a predetermined reference may be a current which is equal to or lower than a critical current of the first superconducting coil unit 110 and the second superconducting coil unit 120.

In this case, a current amount which flows in the first superconducting coil unit 110 and a current amount which flows in the second superconducting coil unit 120 may be equal to each other or a difference of the current amounts may be a predetermined reference or less.

Therefore, the magnetic field generated by the first superconducting coil unit 110 and the magnetic field generated by the second superconducting coil unit 120 are cancelled by each other.

That is, since the first superconducting coil unit 110 and the second superconducting coil unit 120 are in a superconductive state, the resistance is very small to be close to zero. As a result, the same amount of current flows in the first superconducting coil unit 110 and the second superconducting coil unit 120 in accordance with the characteristics of the circuits which are similarly connected in parallel. In this case, the current amounts which flow in the coil units may be different due to a minute characteristic difference of the circuit, which may be adjusted by connecting the adjustment resistors to the superconducting coil units in series. That is, the first adjustment resistor 130 is connected in series to the first superconducting coil unit 110 and the second adjustment resistor 140 is connected in series to the second superconducting coil unit 120 and the resistances of the first adjustment resistor 130 and the second adjustment resistor 140 are adjusted to flow the same amount of current in the first superconducting coil unit 110 and the second superconducting coil unit 120 in a superconductive state. As a result, the magnetic fields generated in the first superconducting coil unit 110 and the second superconducting coil unit 120 have the same strength or a difference of the strengths is a predetermined strength or less so that the magnetic fields are almost the same strength and have opposite directions. Therefore, the magnetic fields are cancelled by each other.

Next, the case when the switching unit 300 is turned on will be described.

When the switching unit 300 is turned on, circuits at both sides of the switching unit 300 are connected and a current flows in the circuits connected through the switching unit 300, instead of the first resistor 400, in accordance with the voltage which is applied by the power supply 200.

In this case, a current which is equal to or higher than a predetermined reference flows in the first superconducting coil unit 110 and the second superconducting coil unit 120, so that the superconductive states of the first superconducting coil unit 110 and the second superconducting coil unit 120 may be broken. As described above, a current which is equal to or higher than the critical current of the coil units flows in the first superconducting coil unit 110 and the second superconducting coil unit 120, so that the superconductive states of the coils may be broken. That is, a reference current amount having a predetermined strength which flows in the pair of the superconducting coil units to break the superconductive state when the switching unit is turned on may be determined depending on a property of a critical current among the superconductive properties of the superconducting coil units.

Accordingly, resistances of the self-resistor of the first superconducting coil unit 110 and the self-resistor of the second superconducting coil unit 120 are increased at different speeds during a predetermined time after the switching unit 300 is turned on.

FIG. 4 is a referential view illustrating a characteristic of a self-resistance of the first superconducting coil unit 110 and the second superconducting coil unit 120 which changes in accordance with time when the switching unit 300 according to an exemplary embodiment of the present invention is turned on.

Referring to FIG. 4, when the switching unit 300 is turned on at a point of 0.1 second, a high current instantaneously flows in the first superconducting coil unit 110 and the second superconducting coil unit 120 so that the superconductive states of the superconducting coil units are broken. In this case, due to the different superconductive properties of the superconducting coil units, gradients of the resistances which increase in accordance with the time are different from each other as illustrated in FIG. 4.

In this case, a difference between the current amount which flows in the first superconducting coil unit 110 and the current amount which flows in the second superconducting coil unit 120 is equal to or larger than a predetermined reference, so that the current asymmetrically flows in the first superconducting coil unit 110 and the second superconducting coil unit 120.

FIG. 5 is a referential view illustrating a characteristic of current amounts which flow in the first superconducting coil unit 110 and the second superconducting coil unit 120 which change in accordance with time when the switching unit 300 according to an exemplary embodiment of the present invention is turned on.

Since the first superconducting coil unit 110 and the second superconducting coil unit 120 which are connected in parallel have different resistances as illustrated in FIG. 4, different currents may flow in accordance with the voltage which is applied to have the same value, as illustrated in FIG. 5.

Accordingly, the strength of the magnetic field generated in the first superconducting coil unit 110 may be different from the strength of the magnetic field generated in the second superconducting coil unit 120. That is, due to different current amounts which flow in the superconducting coil units, the magnetic fields which are generated in the superconducting coil units may have different strengths.

Here, the magnetic field generated by the first superconducting coil unit 110 and the magnetic field generated by the second superconducting coil unit 120 are not cancelled by each other and as a result, the superconducting unit 100 instantaneously generates a predetermined amount of magnetic fields within a predetermined time.

Next, an operation which applies a repulsive force to the plate 500 due to the predetermined amount or more of magnetic field which is instantaneously generated in the superconducting unit 100 within a predetermined time will be described.

The plate may be configured by a conductor.

For example, the plate 500 may be configured by aluminum.

Here, the plate 500 may be disposed to be parallel to the first superconducting coil unit 110 and the second superconducting coil unit 120 of the superconducting unit 100.

Here, eddy current may be generated in the plate 500 due to the magnetic field which is instantaneously generated within the predetermined time by the superconducting unit 100 as described above.

A predetermined amount or more of magnetic field may be instantaneously generated in the plate 500 within a predetermined time due to the generated eddy current.

FIG. 6 is a referential view explaining a change of a magnetic field generated in the superconducting unit 100 and a magnetic field generated in the plate 500 in accordance with the time when the switching unit 300 according to an exemplary embodiment of the present invention is turned on.

Referring to FIG. 6, it is understood that after the switching unit 300 is turned on, the strength of the magnetic field generated in the superconducting unit 100 is increased and thus the strength of the magnetic field generated in the plate 500 is also increased. Here, more precisely, the magnetic field generated in the superconducting unit 100 means a magnetic field at the center of the superconducting unit 100 and the magnetic field generated in the plate 500 means a magnetic field at the center of the plate 500.

In this case, the magnetic field generated due to the eddy current in the plate 500 and the magnetic field generated in the superconducting unit 100 may have opposite directions. As a result, the magnetic field generated due to the eddy current in the plate 500 and the magnetic field generated in the superconducting unit 100 generate a repulsive force between the plate 500 and the superconducting unit 100.

Here, the repulsive force may be calculated by the following Equation 2.

$$F=\int(j_e \times B)dv \qquad \text{Equation 2}$$

(Here, F is the repulsive force, $j_e$ is a density of the eddy current, v is a constant indicating a volume, and B is a magnetic field which is applied to the plate).

Here, ($j_e \times B$) means a Lorentz force which is generated in a minute volume unit and integration is performed on ($j_e \times B$) with respect to the entire plate 500 as represented in Equation 2, to calculate the Lorentz force generated in the plate 500. Here, the Lorentz force calculated as described above becomes the repulsive force.

FIG. 7 is a referential view explaining a change of a repulsive force which is generated between the superconducting unit 100 and the plate 500 due to interaction between a magnetic field generated in the superconducting unit 100 and a magnetic field generated in the plate 500, in accordance with the time, when the switching unit 300 according to an exemplary embodiment of the present invention is turned on.

As described above, the plate 500 is repelled in one direction by the repulsive force generated against the plate 500. The momentum generating apparatus using a superconducting coil according to the exemplary embodiment of the present invention disposes an object on the plate 500 or includes the plate 500 in the object to which a force is applied, to apply the repulsive force generated between the superconducting unit 100 and the plate 500 to the object to be moved.

FIG. 8 is a flowchart of a momentum generating method using a superconducting coil according to another embodiment of the present invention.

A momentum generating method using a superconducting coil according to the exemplary embodiment of the present invention may include a superconductive state maintaining step S100, an instantaneous magnetic field generating step S200, and a momentum generating step S300. Here, the momentum generating method using a superconducting coil according to the embodiment of the present invention may operate in the same manner as that of the momentum generating apparatus using a superconducting coil according to the exemplary embodiment of the present invention which has been described above in detail with reference to FIG. 1. Therefore, redundant parts will be omitted and the momentum generating method will be simply described.

In the superconductive state maintaining step S100, a first resistor 400 and an AC power supply 200 are connected to a superconducting unit 100, which is formed of a pair of a first superconducting coil unit 110 and a second superconducting coil unit 120 which are wound in different directions, have different superconductive properties, and are arranged in parallel to each other and connected in parallel, in series and a current flows to maintain the superconductive state of the pair of the superconducting coil units and a plate 500 is disposed to be parallel to the superconducting unit 100.

In the instantaneous magnetic field generating step S200, both sides of the first resistor 400 are shorted, so that a more current asymmetrically flows in the pair of the first superconducting coil unit 110 and the second superconducting coil unit 120, as compared with the current which has flowed in the pair of the first superconducting coil unit 110 and the second superconducting coil unit 120, and a predetermined amount or more of magnetic field is instantaneously generated in the superconducting unit 100 within a predetermined time.

In the momentum generating step S300, a repulsive force is generated in the plate 500 in accordance with the magnetic field generated in the superconducting unit 100 to levitate the plate 500.

Here, the first superconducting coil unit 110 and the second superconducting coil unit 120 may be high temperature superconductors which are objects whose critical temperature for having a superconductive property is set to a predetermined temperature or higher and may be wounded in opposite directions, so that the superconducting unit has a non-inductive property.

The first superconducting coil unit 110 and the second superconducting coil unit 120 may superconductors which have different critical currents and different N coefficients values).

Next, each step of the momentum generating method using a superconducting coil according to the exemplary embodiment of the present invention will be described in more detail.

In the superconductive state maintaining step S100, a current amount which flows in the first superconducting coil unit 110 and a current amount which flows in the second superconducting coil unit 120 are equal to each other or a difference between the current amounts is a predetermined reference or less and the magnetic field generated by the first superconducting coil unit 110 and the magnetic field generated by the second superconducting coil unit 120 are cancelled by each other.

In the instantaneous magnetic field generating step S200, both sides of the first resistor 400 are shorted using a switch or a circuit which is connected to the first resistor 400 in parallel to instantaneously flow a predetermined reference or higher of current in the first superconducting coil unit 110 and the second superconducting coil unit 120 within a predetermined time. Further, the superconducting unit 100 instantaneously generates a predetermined amount or more of magnetic field within a predetermined time using the first superconducting coil unit 110 and the second superconducting coil unit 120 in which asymmetrical currents flows due to different superconductive properties and which generate different strengths of magnetic fields.

In the momentum generating step S300, an eddy current is generated in the plate 500 due to the magnetic field generated in the instantaneous magnetic field generating step S200, and a predetermined amount or more of the magnetic field is instantaneously generated in the plate 500 due to the generated eddy current within a predetermined time. The magnetic field generated due to the eddy current in the plate 500 and the magnetic field generated in the superconducting unit 100 have opposite directions and generate a repulsive force between the plate 500 and the superconducting unit 100 to move the plate 500 in accordance with the repulsive force.

Meanwhile, the embodiments according to the present invention may be implemented in the form of program instructions that can be executed by computers, and may be recorded in computer readable media. The computer readable media may include program instructions, a data file, a data structure, or a combination thereof. By way of example, and not limitation, computer readable media may comprise computer storage media and communication media. Computer storage media includes both volatile and nonvolatile, removable and non-removable media implemented in any method or technology for storage of information such as computer readable instructions, data structures, program modules or other data. Computer storage media includes, but is not limited to, RAM, ROM, EEPROM, flash memory or other memory technology, CD-ROM, digital versatile disks (DVD) or other optical disk storage, magnetic cassettes, magnetic tape, magnetic disk storage or other magnetic storage devices, or any other medium which can be used to store the desired information and which can accessed by computer. Communication media typically embodies computer readable instructions, data structures, program modules or other data in a modulated data signal such as a carrier wave or other transport mechanism and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared and other wireless media. Combinations of any of the above should also be included within the scope of computer readable media.

As described above, the exemplary embodiments have been described and illustrated in the drawings and the specification. The exemplary embodiments were chosen and described in order to explain certain principles of the invention and their practical application, to thereby enable others skilled in the art to make and utilize various exemplary embodiments of the present invention, as well as various alternatives and modifications thereof. As is evident from the foregoing description, certain aspects of the present invention are not limited by the particular details of the examples illustrated herein, and it is therefore contemplated that other modifications and applications, or equivalents thereof, will occur to those skilled in the art. Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A momentum generating apparatus using a superconducting coil, the apparatus comprising:

a superconducting unit which includes a pair of a first superconducting coil unit and a second superconducting coil unit which are wound in different directions, have different superconductive properties, and are arranged in parallel;

a power supply which supplies an AC power to the superconducting unit;

a switching unit which is connected to the superconducting unit and closes or opens a circuit in accordance with manipulation;

a plate which is configured by a conductor, wherein the plate is disposed to be parallel to the first superconducting coil unit and the second superconducting coil unit of the superconducting unit; and a supporting unit which fixes positions of the first superconducting coil unit and the second superconducting coil unit to be parallel to the plate and guides movement of the plate when the plate moves in a specific direction due to a repulsive force between the superconducting unit and the plate, wherein when the switching unit is turned on to connect circuits at both sides of the switching unit, the superconducting unit instantaneously generates a predetermined amount or more of a magnetic field within a predetermined time.

2. The apparatus of claim 1, wherein the first superconducting coil unit and the second superconducting coil unit are high temperature superconductors which are objects whose critical temperature for having a superconductive property is set to a predetermined temperature or higher.

3. The apparatus of claim 1, wherein the first superconducting coil unit and the second superconducting coil unit are wound in opposite directions, so that the superconducting unit has a non-inductive property.

4. The apparatus of claim 1, wherein the first superconducting coil unit and the second superconducting coil unit are superconductors having different critical currents and different N coefficients and are connected in parallel.

5. The apparatus of claim 1, further comprising:

a first resistor which is connected to the superconducting unit in series, wherein the switching unit is connected to the first resistor in parallel, and when the switching unit is turned on, circuits at both sides of the switching unit are connected and when the switching unit is turned off, a current which flows through the first resistor.

6. The apparatus of claim 5, wherein the superconducting unit includes a first adjustment resistor which is connected to the first superconducting coil unit in series and a second adjustment resistor which is connected to the second superconducting coil unit in series to adjust current amounts which flow in the first superconducting coil unit and the second superconducting coil unit.

7. The apparatus of claim 6, wherein the first adjustment resistor and the second adjustment resistor have resistances which are lower than resistance of the first resistor at a predetermined rate or lower.

8. The apparatus of claim 5, wherein the current flowing through the first resistor when the switching unit is turned off is a first current, and wherein when the switching unit is turned off, the circuits at both sides of the switching unit are disconnected and the first current flows through the first resistor in accordance with a voltage which is applied by the power supply, and a second current and a third current flow through in the first superconducting coil unit and the second superconducting coil unit, respectively, each of the second and third currents having a predetermined reference value or lower so that the first superconducting coil unit and the second superconducting coil unit are maintained to be in a superconductive state.

9. The apparatus of claim 8, wherein when the switching unit is turned off, a first amount of the second current which flows through the first superconducting coil unit and a second amount of the second current which flows through the second superconducting coil unit are equal to each other, or a difference between the first and second amounts is a predetermined reference value or less, and a magnetic field generated by the first superconducting coil unit and a magnetic field generated by the second superconducting coil unit are cancelled by each other.

10. The apparatus of claim 5, wherein the current flowing through the first resistor when the switching unit is turned off is a first current, and wherein when the switching unit is turned on, the circuits at both sides of the switching unit are connected and a second current flows through the switching unit, instead of the first resistor, in accordance with a voltage which is applied by the power supply, a third current and a fourth current flow through in the first superconducting coil unit and the second superconducting coil unit, respectively, each of the third and fourth currents having a predetermined reference value or higher to break a superconductive state of each of the first superconducting coil unit and the second superconducting coil unit, and a resistance of a self-resistor of the first superconducting coil unit and a resistance of a self-resistor of the second superconducting coil unit are increased at different speeds during a predetermined time after the switching unit is turned on.

11. The apparatus of claim 10, wherein when the switching unit is turned on, during a predetermined time after the switching unit is turned on, a difference between a first amount of the third current which flows through the first superconducting coil unit and a second amount of the fourth current which flows through the second superconducting coil unit is equal to or larger than a predetermined reference value, so that the third current and the fourth current asymmetrically flow through in the first superconducting coil unit and the second superconducting coil unit, respectively, and a magnetic field generated by the first superconducting coil unit and a magnetic field generated by the second superconducting coil unit are not cancelled.

12. The apparatus of claim 1, wherein an eddy current is generated in the plate due to the magnetic field which is instantaneously generated in the superconducting unit within the predetermined time, a predetermined amount or more of magnetic field is instantaneously generated in the plate within a predetermined time due to the generated eddy current, and the magnetic field generated in the plate due to the eddy current and the magnetic field generated in the superconducting unit have opposite directions and generate the repulsive force between the plate and the superconducting unit.

* * * * *